US009395663B1

(12) United States Patent
Yokoyama

(10) Patent No.: US 9,395,663 B1
(45) Date of Patent: Jul. 19, 2016

(54) FIXING DEVICE WITH TEMPERATURE DETECTION

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Shuji Yokoyama, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/741,689

(22) Filed: Jun. 17, 2015

(51) Int. Cl.
*G03G 15/20* (2006.01)
*G03G 21/16* (2006.01)

(52) U.S. Cl.
CPC ..... *G03G 15/2039* (2013.01); *G03G 15/20* (2013.01); *G03G 15/2003* (2013.01); *G03G 15/2007* (2013.01); *G03G 15/2017* (2013.01); *G03G 15/2032* (2013.01); *G03G 15/2053* (2013.01); *G03G 15/2067* (2013.01); *G03G 15/2078* (2013.01); *G03G 21/1685* (2013.01); *G03G 2215/2003* (2013.01)

(58) Field of Classification Search
CPC ..... G03G 15/20; G03G 15/2003; G03G 15/2007; G03G 15/2017; G03G 15/2032; G03G 15/2039; G03G 15/2053; G03G 15/2067; G03G 15/2078; G03G 21/1685; G03G 2215/2003
See application file for complete search history.

(56) References Cited

U.S. PATENT DOCUMENTS

2010/0310266 A1* 12/2010 Nakayama ..... G03G 15/2039 399/67
2013/0051877 A1* 2/2013 Sone ..... G03G 15/2053 399/329
2014/0314457 A1 10/2014 Kikuchi

* cited by examiner

*Primary Examiner* — Joseph S Wong
(74) *Attorney, Agent, or Firm* — Amin, Turocy & Watson LLP

(57) ABSTRACT

A fixing device of an exemplary embodiment includes a fixing belt, an induced current generation section, an auxiliary heat generation section, a temperature detection section, and a control section. The fixing belt includes a conductive layer. The induced current generation section opposes the fixing belt in a thickness direction. The induced current generation section performs electromagnetic induction heating on the conductive layer. The auxiliary heat generation section opposes the induced current generation section with the fixing belt interposed therebetween. The temperature detection section detects a temperature of the auxiliary heat generation section. The control section reduces an output from the induced current generation section on the basis of a detection result from the temperature detection section.

9 Claims, 7 Drawing Sheets

FIXING DEVICE WITH TEMPERATURE DETECTION

FIELD

Embodiments described herein relate generally to a fixing device and an image forming apparatus.

BACKGROUND

Currently, there are image forming apparatuses such as a multi-function peripheral (hereinafter, referred to as an "MFP") and a printer. The image forming apparatus includes a fixing device. The fixing device heats a conductive layer of a fixing belt by using an electromagnetic induction heating method (hereinafter, referred to as an "IH" method). The fixing device fixes a toner image to a recording medium with heat of the fixing belt. For example, the fixing device includes an auxiliary heat generation section which opposes an induced current generation section with the fixing belt interposed therebetween. The induced current generation section generates magnetic flux when a high frequency current is applied thereto from an inverter driving circuit. The inverter driving circuit includes an insulated gate bipolar transistor (IGBT) element. The auxiliary heat generation section concentrates magnetic flux during electromagnetic induction heating so as to increase an amount of generated heat in the fixing belt. The auxiliary heat generation section may excessively increase a temperature of the IGBT element and thus the IGBT element may be damaged when a high output is continued, such as during continuous sheet passing or during warming-up.

DETAILED DESCRIPTION

Figure 1:
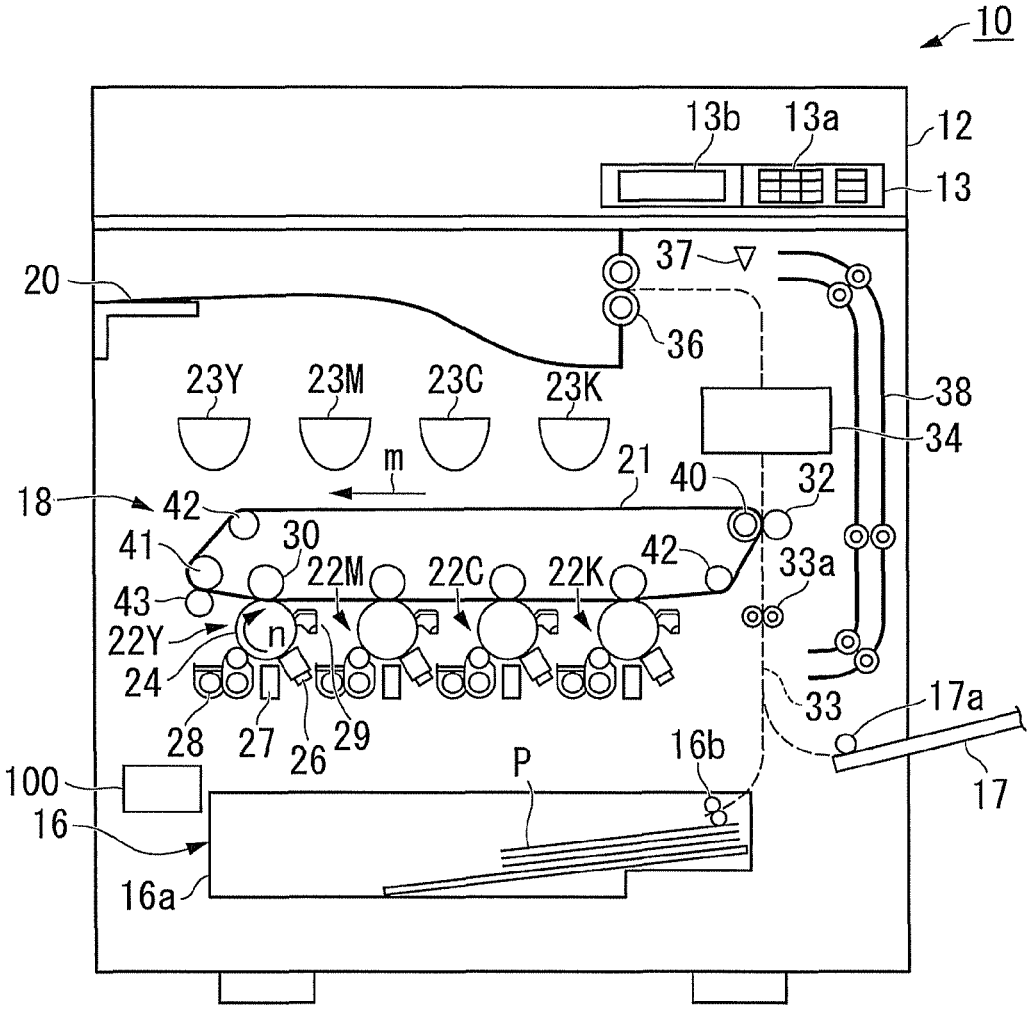
FIG. 1 is a side view of an image forming apparatus according to an exemplary embodiment.

A fixing device of an exemplary embodiment includes a fixing belt, an induced current generation section, an auxiliary heat generation section, a temperature detection section, and a control section. The fixing belt includes a conductive layer. The induced current generation section opposes the fixing belt in a thickness direction. The induced current generation section performs electromagnetic induction heating on the conductive layer. The auxiliary heat generation section opposes the induced current generation section with the fixing belt interposed therebetween. The temperature detection section detects a temperature of the auxiliary heat generation section. The control section reduces an output from the induced current generation section on the basis of a detection result from the temperature detection section.

Hereinafter, an image forming apparatus 10 of an exemplary embodiment will be described with reference to the drawings. In the respective drawings, the same constituent elements are given the same reference numeral.

FIG. 1 is a side view of the image forming apparatus 10 according to the exemplary embodiment. Hereinafter, an MFP 10 will be described as an example of the image forming apparatus 10.

As illustrated in FIG. 1, the MFP 10 includes a scanner 12, a control panel 13, a paper feeding cassette unit 16, a paper feeding tray 17, a printer unit 18, and a paper discharge unit 20. The MFP 10 includes a CPU 100 which controls the entire MET 10. The CPU 100 controls a main body control circuit 101 (refer to FIG. 2).

The scanner 12 reads an original document image. The control panel 13 includes an input key 13*a* and a display portion 13*b*. For example, the input key 13*a* receives an input operation from a user. For example, the display portion 13*b* is of a touch panel type. The display portion 13*b* receives an input operation from the user and performs corresponding display to the user.

The paper feeding cassette unit 16 includes a paper feeding cassette 16*a* and pickup rollers 16*b*. The paper feeding cassette 16*a* stores a sheet P which is a recording medium. The pickup rollers 16*b* extract the sheet P from the paper feeding cassette 16*a*.

The paper feeding cassette 16*a* feeds an unused sheet P. The paper feeding tray 17 feeds an unused sheet P with a pickup roller 17*a*.

The printer unit 18 forms an image of the original document image read by the scanner 12. The printer unit 18 includes an intermediate transfer belt 21. The printer unit 18 supports the intermediate transfer belt 21 with a backup roller 40, a driven roller 41, and a tension roller 42. The backup roller 40 includes a driving portion (not illustrated). The printer unit 18 rotates the intermediate transfer belt 21 in a direction of an arrow m.

The printer unit 18 includes four sets of image forming stations 22Y, 22M, 22C and 22K. The image forming stations 22Y, 22M, 22C and 22K are used to respectively form yellow (Y), magenta (M), cyan (C) and black (K) images. The image forming stations 22Y, 22M, 22C and 22K are disposed in parallel in the rotation direction of the intermediate transfer belt 21 below the intermediate transfer belt 21.

The printer unit 18 includes cartridges 23Y, 23M, 23C and 23K over the image forming stations 22Y, 22M, 22C and 22K. The cartridges 23Y, 23M, 23C and 23K respectively store yellow (Y), magenta (M), cyan (C) and black (K) toner particles to be supplied.

Hereinafter, among the image forming stations 22Y, 22M, 22C and 22K, the yellow (Y) image forming station 22Y will be described later as an example. The image forming stations 22M, 22C and 22K have the same configurations as a configuration of the image forming station 22Y, and thus detailed description thereof will be omitted.

The image forming station 22Y includes an electrostatic charger 26, an exposure scanning head 27, a developing device 28, and a photoconductor cleaner 29. The electrostatic charger 26, the exposure scanning head 27, the developing device 28, and the photoconductor cleaner 29 are disposed around a photoconductive drum 24 which is rotated in an arrow n direction.

The image forming station 22Y includes a primary transfer roller 30. The primary transfer roller 30 opposes the photoconductive drum 24 with the intermediate transfer belt 21 interposed therebetween.

In the image forming station 22Y, the photoconductive drum 24 is charged by the electrostatic charger 26 and is then exposed to light by the exposure scanning head 27. The image forming station 22Y forms an electrostatic latent image on the photoconductive drum 24. The developing device 28 develops the electrostatic latent image on the photoconductive drum 24 by using a developer containing two components including toner and carriers.

The primary transfer roller 30 primarily transfers a toner image formed on the photoconductive drum 24 onto the intermediate transfer belt 21. The image forming stations 22Y, 22M, 22C and 22K form a color toner image on the intermediate transfer belt 21 by using the primary transfer roller 30. The color toner image is formed by sequentially overlapping yellow (Y), magenta (M), cyan (C) and black (K) toner images on each other. The photoconductor cleaner 29 removes toner remaining on the photoconductive drum 24 after the primary transfer.

The printer unit 18 includes a secondary transfer roller 32. The secondary transfer roller 32 opposes the backup roller with the intermediate transfer belt 21 interposed therebetween. The secondary transfer roller 32 secondarily transfers the color toner image on the intermediate transfer belt 21 onto the sheet P. The sheet P is fed from the paper feeding cassette unit 16 or the manual paper feeding tray 17 along a transport path 33.

The printer unit 18 includes a belt cleaner 43 which opposes the driven roller 41 via the intermediate transfer belt 21. The belt cleaner 43 removes toner remaining on the intermediate transfer belt 21 after the secondary transfer. In addition, an image forming portion includes the intermediate transfer belt 21, the four sets of image forming stations (22Y, 22M, 22C and 22K), and the secondary transfer roller 32.

The printer unit 18 includes resist rollers 33*a*, a fixing device 34, and paper discharge rollers 36 along the transport path 33. The printer unit 18 includes a branching portion 37 and a reverse transport portion 38 on the downstream side of the fixing device 34. The branching portion 37 forwards the sheet P after undergoing fixation to the paper discharge unit 20 or the reverse transport portion 38. In a case of duplex printing, the reverse transport portion 38 reverses and transports the sheet P which is sent from the branching portion 37, in the direction of the resist rollers 33*a*. The MFP 10 forms a fixed toner image on the sheet P in the printer unit 18. The MFP 10 discharges the sheet P on which the fixed toner image is formed to the paper discharge unit 20.

The MFP 10 is not limited to a tandem developing method. In the MFP 10, the number of developing device 28 is not limited thereto either. The MFP 10 may direct transfer a toner image onto the sheet P from the photoconductive drum 24.

Hereinafter, the fixing device 34 will be described in detail.

Figure 2:
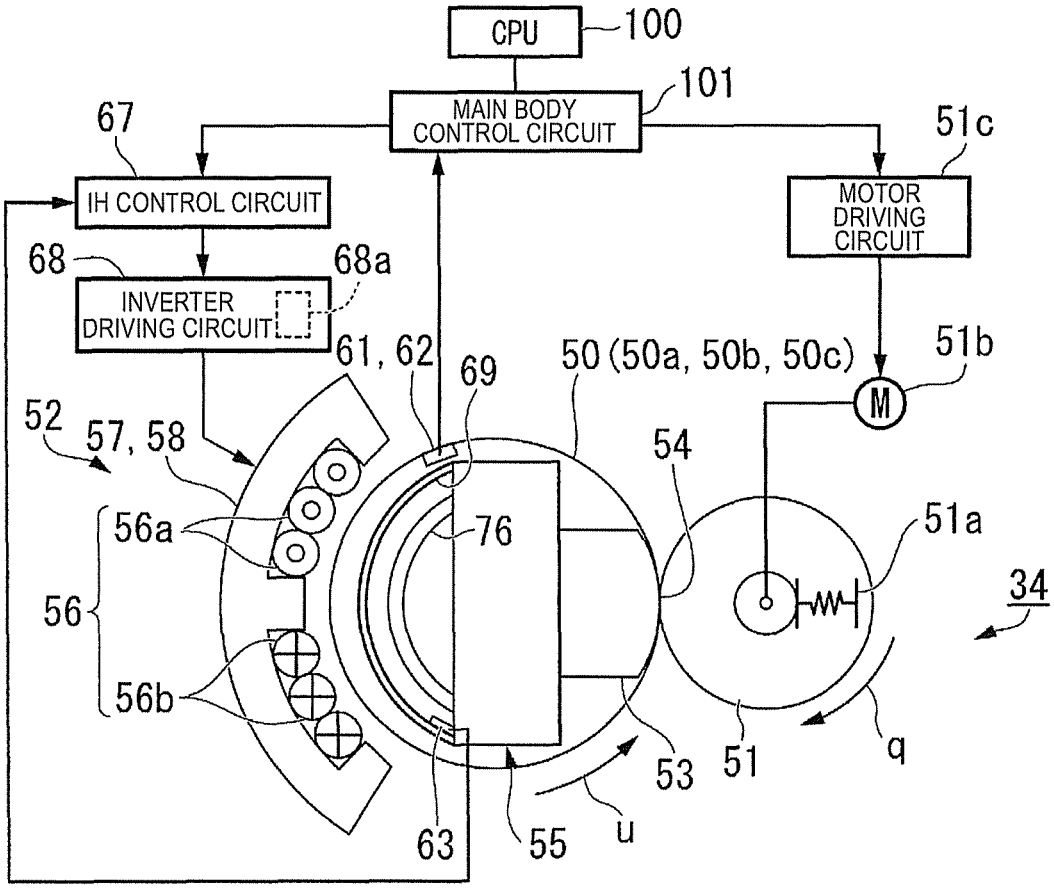
FIG. 2 is a side view of a fixing device including a control block of an IH coil unit.

FIG. 2 is a side view of the fixing device 34 including a control block of an electromagnetic induction heating coil unit 52 according to the exemplary embodiment. The electromagnetic induction heating coil unit is referred to as an "IH coil unit".

As illustrated in FIG. 2, the fixing device 34 includes a fixing belt 50, a press roller 51, the IH coil unit 52, and an auxiliary heat generation plate 69.

The fixing belt 50 is a tubular endless belt. An internal belt mechanism 55 which supports a nip pad 53 and the auxiliary heat generation plate 69 is disposed on an inner circumferential side of the fixing belt 50.

The fixing belt 50 is rotated in an arrow u direction by following the press roller 51. Alternatively, the fixing belt 50 may be rotated in the arrow u direction separately from the press roller 51. If the fixing belt 50 and the press roller 51 are rotated separately from each other, a one-way clutch may be provided so that a speed difference between the fixing belt 50 and the press roller 51 is not generated.

In the fixing belt 50, a heat generation layer 50*a* (conductive layer) which is a heat generation portion and a release layer 50*c* are sequentially laminated on a base layer 50*b*. In addition, a layer structure of the fixing belt 50 is not limited thereto as long as the fixing belt 50 includes the heat generation layer 50*a*.

For example, the base layer 50*b* is made of a polyimide resin (PI). For example, the heat generation layer 50*a* is made of a nonmagnetic metal such as copper (Cu). For example, the release layer 50*c* is made of a fluororesin such as a tetrafluoroethylene-perfluoroalkyl vinyl ether copolymer resin (PFA).

In the fixing belt 50, in order to realize rapid warming-up, the heat generation layer 50*a* is thinned so as to reduce the heat capacity. The fixing belt 50 having the small heat capacity reduces the time required in warming-up. Energy consumption is reduced by reducing the time required in the warming-up.

For example, in the fixing belt 50, a thickness of the copper layer of the heat generation layer 50*a* is 10 μm in order to reduce the heat capacity. For example, the heat generation layer 50*a* is covered by a protective layer such as nickel. The protective layer such as nickel prevents oxidation of the copper layer. The protective layer such as nickel improves mechanical strength of the copper layer.

The heat generation layer 50*a* may be formed on the base layer 50*b* made of a polyimide resin through electroless nickel plating and copper plating. Through the electroless nickel plating, adhesion strength between the base layer 50*b* and the heat generation layer 50*a* is improved. Through the electroless nickel plating, mechanical strength of the heat generation layer 50*a* is improved.

A surface of the base layer 50*b* may be roughened through sand blasting or chemical etching. Since the surface of the base layer 50*b* is roughened, adhesion strength between the base layer 50*b* and the plated nickel of the heat generation layer 50*a* is further mechanically improved.

A metal such as titanium (Ti) may be dispersed into the polyimide resin forming the base layer 50*b*. If a metal is dispersed into the base layer 50*b*, adhesion strength between the base layer 50*b* and the plated nickel of the heat generation layer 50*a* is further improved.

The heat generation layer 50*a* may be made of, for example, nickel, iron (Fe), stainless steel, aluminum (Al), and silver (Ag). The heat generation layer 50*a* may employ two or more kinds of alloys, and may employ two or more kinds of layered metals which overlap each other.

In the heat generation layer 50*a*, an eddy current is generated by magnetic flux which is generated by the IH coil unit 52. The heat generation layer 50*a* generate Joule heat by using the eddy current and electric resistance of the heat generation layer 50*a* so as to heat the fixing belt 50.

Figure 3:
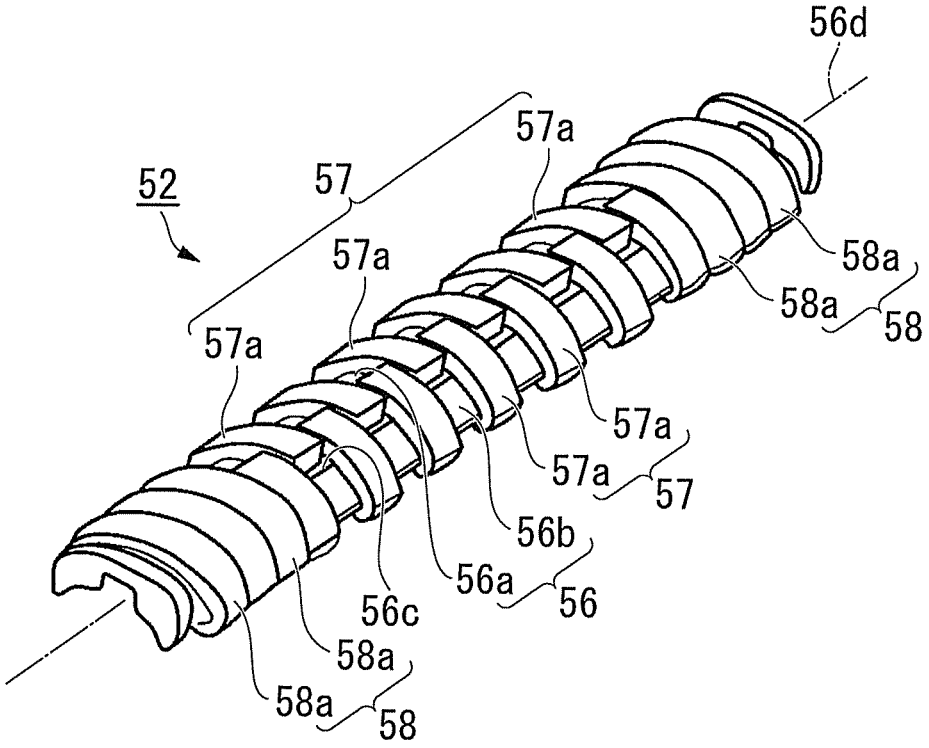
FIG. 3 is a perspective view of the IH coil unit.

FIG. 3 is a perspective view of the IH coil unit 52 according to the exemplary embodiment.

As illustrated in FIG. 3, the IH coil unit 52 includes a coil 56, a first core 57, and second cores 58.

The coil 56 generates magnetic flux when a high frequency current is applied thereto. The coil 56 opposes the fixing belt 50 in a thickness direction. A longitudinal direction of the coil 56 matches a width direction (hereinafter, referred to as a "belt width direction") of the fixing belt 50.

The first core 57 and the second cores 58 cover an opposite side (hereinafter, referred to as a "rear surface side") of the coil 56 to the fixing belt 50. The first core 57 and the second cores 58 prevent the magnetic flux generated by the coil 56 from leaking out of the rear surface side. The first core 57 and the second cores 58 cause the magnetic flux from the coil 56 to concentrate on the fixing belt 50.

The first core 57 includes a plurality of one-wing portions 57*a*. The plurality of one-wing portions 57*a* are alternately disposed in a zigzag form so as to form axial symmetry with respect to a central line 56*d* lying in the longitudinal direction of the coil 56.

The second cores 58 are disposed on both sides of the first core 57 in the longitudinal direction. Each of the second cores 58 includes a plurality of two-wing portions 58*a* which extend over both wings of the coil 56.

For example, the one-wing portions 57*a* and the two-wing portions 58*a* are made of magnetic materials such as a nickel-zinc alloy (Ni—Zn) and a manganese-nickel alloy (Mn—Ni).

In the first core 57, the plurality of one-wing portions 57*a* restrict the magnetic flux generated by the coil 56. The magnetic flux generated by the coil 56 is alternately restricted every other one-wings of the coil 56 so as to form axial symmetry with respect to the central line 56*d*. In the first core 57, the plurality of one-wing portions 57*a* cause the magnetic flux from the coil 56 to concentrate on the fixing belt 50.

In the second cores 58, the plurality of two-wing portions 58*a* restrict the magnetic flux generated by the coil 56. The magnetic flux generated by the coil 56 is restricted by both of the wings of the coil 56 on both sides of the first core 57. In the second cores 58, the plurality of two-wing portions 58*a* cause the magnetic flux from the coil 56 to concentrate on the fixing belt 50. The magnetic flux concentration power of the second cores 58 is greater than the magnetic flux concentration power of the first core 57.

The coil 56 includes a first wing 56*a* and a second wing 56*b*. The first wing 56*a* is disposed on one side with respect to the central line 56*d*. The second wing 56*b* is disposed on the other side with respect to the central line 56*d*. A window portion 56*c* is formed between the first wing 56*a* and the second wing 56*b* and on an inner side of the coil 56 in the longitudinal direction.

As illustrated in FIG. 2, the IH coil unit 52 generates an inducted current while the fixing belt 50 is rotated in the arrow u direction. The heat generation layer 50*a* of the fixing belt 50 opposing the IH coil unit 52 generates heat due to the induced current.

For example, a litz wire is used as the coil 56. The litz wire is formed by bundling a plurality of copper wires coated with heat-resistive polyamide-imide which is an insulating material. The coil 56 is formed by winding a conductive coil.

The coil 56 generates magnetic flux when a high frequency current is applied thereto by an inverter driving circuit 68. For example, the inverter driving circuit 68 includes an insulated gate bipolar transistor (IGBT) element 68*a*.

The auxiliary heat generation plate 69 has an arc shape disposed in a circumferential direction of the fixing belt 50. The auxiliary heat generation plate 69 opposes the first wing 56*a* and the second wing 56*b* of the coil 56 via the fixing belt 50. The auxiliary heat generation plate 69 causes an eddy current due to the magnetic flux generated by the IH coil unit 52 so as to generate heat. The auxiliary heat generation plate 69 assists the IH coil unit 52 with heat generation from the heat generation layer 50*a* of the fixing belt 50. The auxiliary heat generation plate 69 assists heating of the fixing belt 50.

For example, a length of the auxiliary heat generation plate 69 in the belt width direction is greater than a length (hereinafter, referred to as a "sheet width") of a sheet passing region in the belt width direction. The sheet width is a width of a sheet having the greatest short side width among sheets to be used. For example, the sheet width is the same as a short side width of A3 paper.

The auxiliary heat generation plate 69 is supported by a shield 76 on an opposite side to the coil 56. The shield 76 has the same arc shape as the auxiliary heat generation plate 69. The shield 76 is disposed on an inner circumferential side of the auxiliary heat generation plate 69. For example, the shield 76 is made of a nonmagnetic material such as aluminum or copper. The shield 76 shields the magnetic flux from the IH coil unit 52. The shield 76 prevents the magnetic flux from influencing the nip pad 53 or the like.

The auxiliary heat generation plate 69 is made of a magnetic shunt alloy. The magnetic shunt alloy which is an alloy of iron and nickel has a Curie point of 220° C. to 230° C. The magnetic shunt alloy is a thin metal member. If the Curie point is exceeded, the auxiliary heat generation plate 69 has a weakened magnetic force, and thus heating assistance of the fixing belt 50 is weakened. Since the auxiliary heat generation plate 69 is made of the magnetic shunt alloy, the fixing belt 50 is heated within a range of heat resistance temperatures. The auxiliary heat generation plate 69 and the fixing belt 50 are maintained in a contact state, and thus a temperature difference between the auxiliary heat generation plate 69 and the fixing belt 50 is reduced.

The auxiliary heat generation plate 69 may be made of a thin metal member having a magnetic characteristic, such as iron, nickel, and stainless steel. In addition, the auxiliary heat generation plate 69 may be made of a resin containing magnetic powder as long as the resin has a magnetic characteristic. The auxiliary heat generation plate 69 may be made of the following magnetic material (ferrite). The magnetic material (ferrite) promotes heat generation of the fixing belt 50 with magnetic flux caused by an eddy current. The magnetic material (ferrite) does not generate heat even if receiving the magnetic flux caused by the induced current. The auxiliary heat generation plate 69 is not limited to a thin plate member.

The auxiliary heat generation plate 69 may be provided with a plurality of slits perpendicular to a direction of a current induced by the IH coil unit 52. If the auxiliary heat generation plate 69 is provided with the plurality of slits, an eddy current generated in the auxiliary heat generation plate 69 is divided thereby. In other words, the eddy current generated in the auxiliary heat generation plate 69 becomes an eddy occurring between the slits. Since the auxiliary heat generation plate 69 is provided with the plurality of slits, a size of an eddy occurring between the slits can be reduced more than if the auxiliary heat generation plate 69 is not provided with the plurality of slits. As a result of the size of the eddy occurring between the slits being reduced, heat generation of the auxiliary heat generation plate 69 can be reduced.

The auxiliary heat generation plate 69 may be disposed with a minute gap with respect to the fixing belt 50. The auxiliary heat generation plate 69 may be in contact with the inner circumferential surface of the fixing belt 50.

Both arc-shaped ends of the auxiliary heat generation plate 69 are supported by the internal belt mechanism 55. For example, the arc-shaped upper end of the auxiliary heat generation plate 69 is supported via a swing shaft 69*a* (refer to FIG. 6) disposed in the belt width direction. The arc-shaped lower end of the auxiliary heat generation plate 69 is supported via a biasing member 69*b* (refer to FIG. 6) such as a spring. The auxiliary heat generation plate 69 is biased toward the inner circumferential surface of the fixing belt 50.

The auxiliary heat generation plate 69 may be biased toward the fixing belt 50 without swinging. The auxiliary heat generation plate 69 may be controlled to approach and separate from the fixing belt 50. For example, the auxiliary heat generation plate 69 may separate from the fixing belt 50 before warming up the fixing device 34, and may come into contact with the fixing belt 50 after warming up the fixing device 34.

Figure 4:
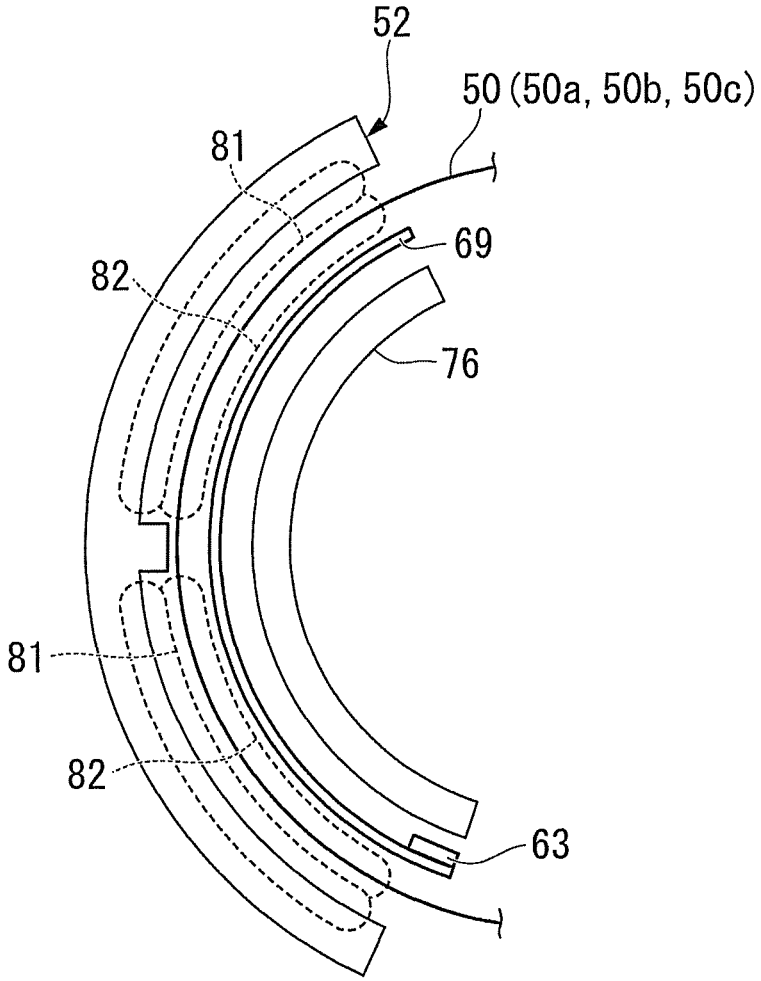
FIG. 4 is a diagram illustrating magnetic paths directed to a fixing belt and an auxiliary heat generation plate by magnetic flux from the IH coil unit.

FIG. 4 is a diagram illustrating magnetic paths directed to the fixing belt 50 and the auxiliary heat generation plate 69 by magnetic flux from the IH coil unit 52 according to the exemplary embodiment. In FIG. 4, for convenience, the coil 56 and the like are not illustrated. In FIG. 4, for convenience, the fixing belt 50 and the auxiliary heat generation plate 69 separate from each other.

As illustrated in FIG. 4, magnetic flux generated by the IH coil unit 52 forms a first magnetic path 81 induced in the heat generation layer 50*a* of the fixing belt 50. The magnetic flux generated by the IH coil unit 52 forms a second magnetic path 82 induced in the auxiliary heat generation plate 69.

The auxiliary heat generation plate 69 generates heat due to the magnetic flux generated by the IH coil unit 52. The auxiliary heat generation plate 69 assists the heat generation layer 50*a* of the fixing belt 50 in generating heat during warming-up of the fixing belt 50 so as to accelerate the warming-up. The auxiliary heat generation plate 69 assists the heat generation layer 50*a* of the fixing belt 50 in generating heat during printing. A fixation temperature is maintained by assisting the heat generation layer 50*a* of the fixing belt 50 in generating heat.

As illustrated in FIG. 2, the nip pad 53 is a pressing portion which presses the inner circumferential surface of the fixing belt 50 toward the press roller 51 side. A nip 54 is formed between the fixing belt 50 and the press roller 51.

For example, the nip pad 53 is made of an elastic material such as silicon rubber or a fluororubber. The nip pad 53 may be made of a heat resistive resin such as a polyimide resin (PI), a polyphenylene sulfide resin (PPS), a polyether sulfone resin (PES), liquid crystal polymer (LCP), or phenol resin (PF).

For example, a sheet-like friction reducing member is disposed between the fixing belt 50 and the nip pad 53. The friction reducing member is formed of, for example, a sheet member or a release layer which is favorably slid and has good abrasion resistance. The friction reducing member is fixedly supported by the internal belt mechanism 55. The friction reducing member is slidably in contact with the inner circumferential surface of the traveling fixing belt 50. The friction reducing member may be formed of the following lubricious sheet member. The sheet member may be formed of a glass fiber sheet impregnated with a fluororesin.

The press roller 51 includes a heat resistive silicon sponge, a silicon rubber layer, or the like around its core. For example, a release layer is disposed on a surface of the press roller 51. The release layer is made of a fluororesin such as a PFA resin. The press roller 51 presses the fixing belt 50 with a pressing mechanism 51*a*. The press roller 51 is a pressing portion which presses the fixing belt 50 along with the nip pad 53. The press roller 51 is rotated in an arrow q direction by a motor 51*b*. The motor 51*b* is driven by a motor driving circuit 51*c* which is controlled by the main body control circuit 101.

A center thermistor 61, an edge thermistor 62, and a thermostat 63 are disposed further toward the inside of the fixing belt 50 than the inner circumferential surface of the fixing belt 50.

The center thermistor 61 and the edge thermistor 62 detect a temperature (hereinafter, referred to as a "belt temperature") of the fixing belt 50, and output the detected temperature to the main body control circuit 101. The center thermistor 61 and the edge thermistor 62 function as a belt temperature detection section. The center thermistor 61 is disposed inside the fixing belt 50 in the belt width direction. The edge thermistor 62 is disposed further outward than the IH coil unit 52 in the belt width direction. The edge thermistor 62 detects a temperature of an outer part of the fixing belt 50 in the belt width direction with high accuracy without being influenced by the IH coil unit 52.

The main body control circuit 101 controls an IH control circuit 67 according to detection results from the center thermistor 61 and the edge thermistor 62. The IH control circuit 67 controls a high frequency current output from the inverter driving circuit 68 under the control of the main body control circuit 101. The fixing belt 50 is maintained in various control temperature ranges in accordance with an output from the inverter driving circuit 68.

The thermostat 63 functions as a safety device of the fixing device 34. The thermostat 63 operates if the fixing belt 50 abnormally generates heat and thus a temperature thereof increases to a cut-off threshold value. If the thermostat 63 operates, a current does not flow to the IH coil unit 52. The MFP 10 stops its operation if a current does not flow to the IH coil unit 52, and thus abnormal heat generation from the fixing device 34 is prevented.

Figure 6:
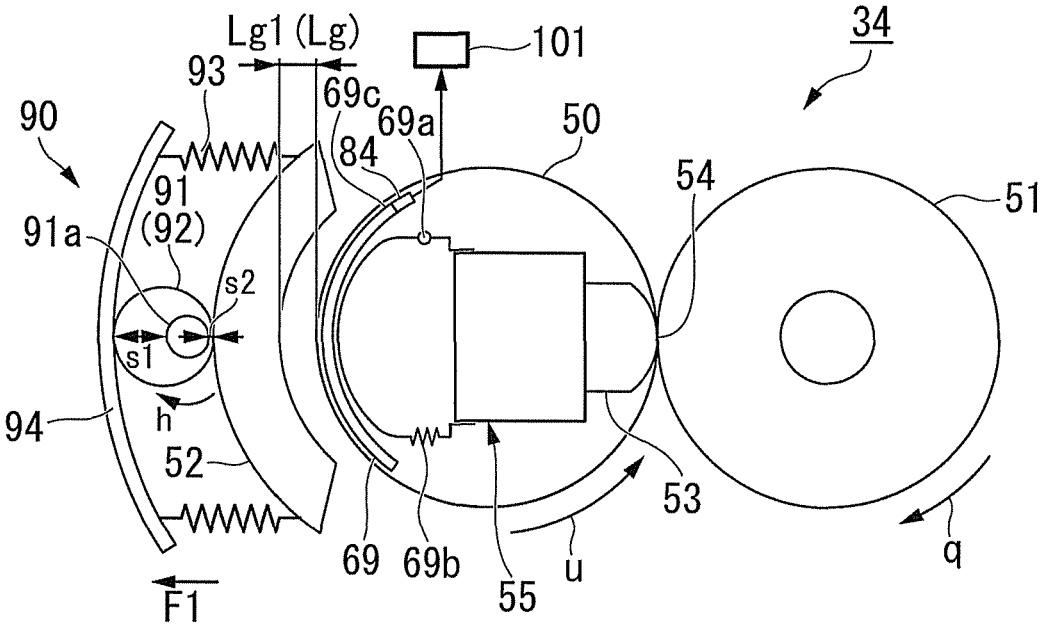
FIG. 6 is a side view illustrating a state in which the IH coil unit separates from an outer circumferential surface of the fixing belt.

FIG. 6 is a side view illustrating a state in which the IH coil unit 52 according to the exemplary embodiment separates from the outer circumferential surface of the fixing belt 50.

Figure 7:
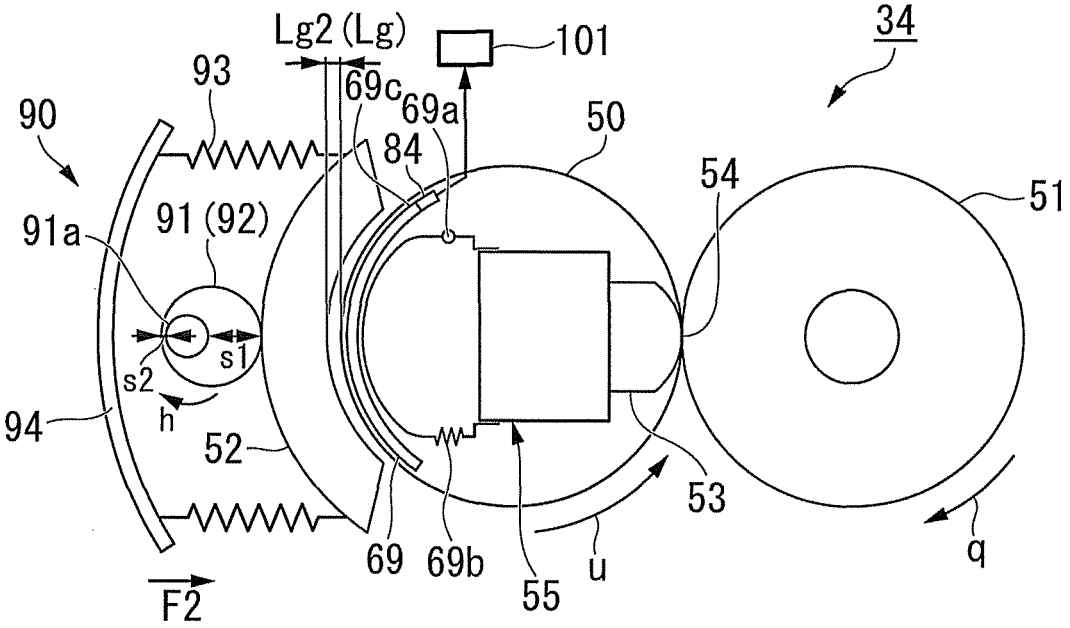
FIG. 7 is a side view illustrating a state in which the IH coil unit approaches the outer circumferential surface of the fixing belt.

FIG. 7 is a side view illustrating a state in which the IH coil unit 52 according to the exemplary embodiment approaches the outer circumferential surface of the fixing belt 50. In FIGS. 6 and 7, a gap Lg indicates a gap between the IH coil unit 52 and the outer circumferential surface of the fixing belt 50.

Figure 8:
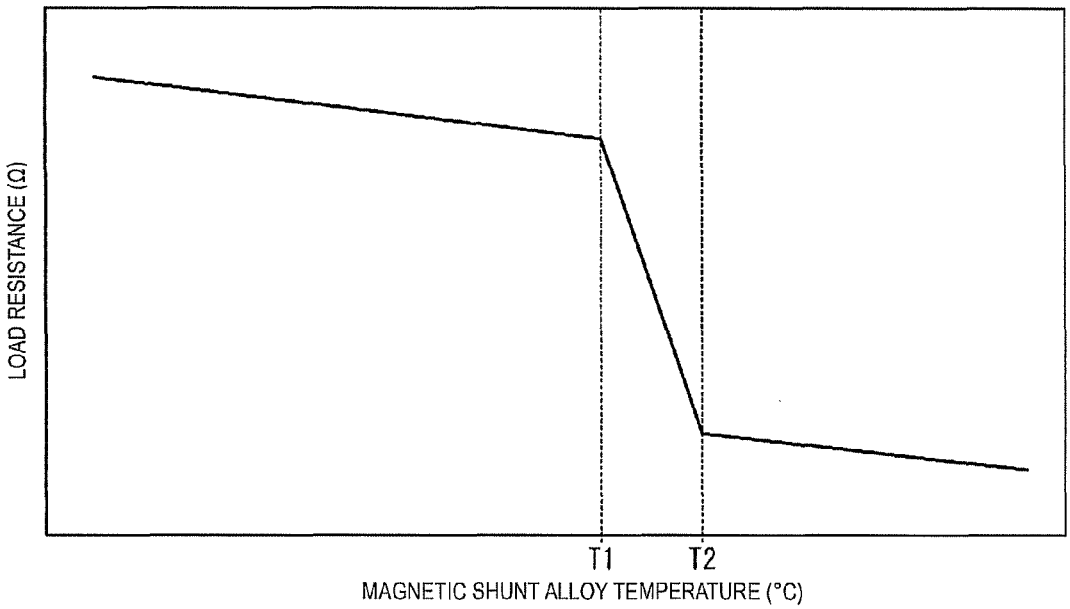
FIG. 8 is a graph illustrating a relationship between a magnetic shunt alloy temperature and load resistance.

FIG. 8 is a graph illustrating a relationship between a magnetic shunt alloy temperature and load resistance.

Here, the "magnetic shunt alloy temperature" indicates a temperature of the auxiliary heat generation plate 69 made of a magnetic shunt alloy. The "load resistance" is electric resistance caused by the presence of the auxiliary heat generation plate 69 under magnetic flux generated by the IH coil unit 52. In FIG. 8, a region between temperatures T1 and T2 is a magnetism transition region of the magnetic shunt alloy.

Hereinafter, a description will be made of a relationship between the magnetic shunt alloy temperature and the load resistance with reference to FIG. 8.

As illustrated in FIG. 8, the load resistance gradually and smoothly decreases as the magnetic shunt alloy temperature increases until the magnetic shunt alloy temperature reaches the temperature T1 (Curie point). If the magnetic shunt alloy temperature exceeds the temperature T1 (Curie point), the load resistance rapidly decreases until the magnetic shunt alloy temperature reaches the temperature T2. If the magnetic shunt alloy temperature exceeds the temperature T2, the load resistance gradually and smoothly decreases.

Hereinafter, main portions of the fixing device 34 according to the exemplary embodiment will be described with reference to FIG. 6.

As illustrated in FIG. 6, a temperature detection section 84 is disposed further toward the inside of the fixing belt 50 in a diameter direction than the inner circumferential surface of the fixing belt 50. An extending portion 69*c* is provided in the auxiliary heat generation plate 69. The extending portion 69*c* extends so as to oppose an end of the IH coil unit in a circumferential direction of the fixing belt 50 (hereinafter, referred to as a "belt circumferential direction"). The temperature detection section 84 is attached to the extending portion 69*c*. The temperature detection section 84 detects a temperature of the auxiliary heat generation plate 69. The main body control circuit 101 acquires the temperature of the auxiliary heat generation plate 69 detected by the temperature detection section 84. The main body control circuit 101 may acquire the temperature of the auxiliary heat generation plate 69 detected by the temperature detection section 84 via other circuits such as a logic circuit.

The main body control circuit 101 controls the IH coil unit 52 on the basis of a detection result from the temperature detection section 84. In other words, the main body control circuit 101 controls the IH coil unit 52 on the basis of a magnetic shunt alloy temperature.

For the following reason, the main body control circuit 101 performs control on the basis of a magnetic shunt alloy temperature. If the auxiliary heat generation plate 69 is made of a magnetic shunt alloy, load resistance of the IGBT element 68*a* is reduced when a magnetic shunt alloy temperature exceeds the Curie point. If power is to be kept at a constant value when the load resistance of the IGBT element 68*a* is being reduced, a large amount of current flows according to Ohm's law. If a large amount of current flows, a heat generation load of the IGBT element 68*a* may increase.

The main body control circuit 101 determines whether or not the IH coil unit 52 will be stopped on the basis of a magnetic shunt alloy temperature. For example, if the magnetic shunt alloy temperature is equal to or higher than the temperature T1, the main body control circuit 101 determines that the IH coil unit 52 will be stopped. The main body control circuit 101 stops the IH coil unit 52 so as to prevent the temperature of the IGBT element 68*a* from excessively increasing. The main body control circuit 101 prevents the temperature of the IGBT element 68*a* from excessively increasing and thus prevents the IGBT element 68*a* from being damaged.

If the magnetic shunt alloy temperature is equal to or higher than the temperature T1, the main body control circuit 101 may reduce an output from the IH coil unit 52. For example, the main body control circuit 101 reduces the amount of power supplied to the IH coil unit 52. The main body control circuit 101 reduces the output from the IH coil unit 52 so as to prevent a temperature of the IGBT element 68*a* from excessively increasing. The main body control circuit 101 prevents a temperature of the IGBT element 68*a* from excessively increasing and thus prevents the IGBT element 68*a* from being damaged. The fixing device 34 continuously performs driving in a state in which the output from the IH coil unit 52 is reduced.

As illustrated in FIG. 6, a driving section 90 is provided further toward the outside of the fixing belt 50 in the diameter direction than the outer circumferential surface of the fixing belt 50. The driving section 90 includes an eccentric cam 91, a cam motor 92, an elastic member 93, and a support member 94. The eccentric cam 91 includes a shaft 91*a* parallel to the belt width direction. The cam motor 92 is driven by the motor driving circuit 51*c* (refer to FIG. 2). The eccentric cam 91 is rotated in an arrow h direction centering on the shaft 91*a* by the cam motor 92. The elastic member 93 is formed of a spring or the like. The support member 94 supports the IH coil unit 52 via the elastic member 93.

The motor driving circuit 51*c* controls the cam motor 92 on the basis of a detection result from the temperature detection section 84. For example, the Curie point (the temperature T1) of the auxiliary heat generation plate 69 is set as a temperature threshold value. The motor driving circuit 51*c* controls the cam motor 92 if a detection result from the temperature detection section 84 reaches the temperature threshold value. The motor driving circuit 51*c* adjusts the gap Lg by controlling the cam motor 92.

If the auxiliary heat generation plate 69 is in contact with the inner circumferential surface of the fixing belt 50, the motor driving circuit 51*c* may control the cam motor 92 on the basis of detection results from the center thermistor 61 and the edge thermistor 62. The center thermistor 61 and the edge thermistor 62 detect a temperature of the fixing belt 50, and thus a temperature of the auxiliary heat generation plate 69 is indirectly detected.

As illustrated in FIGS. 6 and 7, the driving section 90 adjusts the gap Lg by moving the eccentric cam 91. The support member 94 is fixed at a constant position.

The driving section 90 may adjust the gap Lg by using a piston cylinder mechanism.

If a temperature of the auxiliary heat generation plate 69 is equal to or higher than the temperature threshold value (hereinafter, referred to as "at a high magnetic shunt alloy temperature"), the gap Lg is relatively reduced. On the other hand, if a temperature of the auxiliary heat generation plate 69 is lower than the temperature threshold value (hereinafter, referred to as "at a low magnetic shunt alloy temperature"), the gap Lg is relatively increased.

Hereinafter, a state in which a magnetic shunt alloy temperature is low will be described with reference to FIG. 6.

As illustrated in FIG. 6, the IH coil unit 52 is biased in an arrow F1 direction due to an elastic force of the elastic member 93. The eccentric cam 91 is stopped at a position where a long side 51 thereof comes into contact with the support member 94. The eccentric cam 91 is stopped at a position where a short side s2 thereof comes into contact with a surface (hereinafter, referred to as a "rear surface") of the IH coil unit 52 on an opposite side to the fixing belt 50. A surface (hereinafter, referred to as a "front surface") of the IH coil unit 52 on the fixing belt 50 side separates from the outer circumferential surface of the fixing belt 50 with a first gap Lg1 therebetween due to an elastic force of the elastic member 93.

At a low magnetic shunt alloy temperature, the IH coil unit 52 is designed to achieve the optimum conditions in relation to resistance of the magnetic shunt alloy, the fixing belt 50, or the like. The position of the IH coil unit 52 illustrated in FIG. 6 is a position of the IH coil unit 52 when a magnetic shunt alloy temperature is low. The position of the IH coil unit 52 at a low magnetic shunt alloy temperature is a reference position of the IH coil unit 52. The IH coil unit 52 at a low magnetic shunt alloy temperature is farther away from the fixing belt 50 than the IH coil unit 52 at a high magnetic shunt alloy temperature. As the IH coil unit 52 becomes farther away from the fixing belt 50, magnetic flux is weakened. Magnetic flux when the IH coil unit 52 separates from the fixing belt 50 with the first gap Lg1 therebetween is weaker than magnetic flux when the IH coil unit 52 separates from the fixing belt 50 with a second gap Lg2 (refer to FIG. 7) therebetween. However, electric resistance of the magnetic shunt alloy at a low magnetic shunt alloy temperature is greater than at a high magnetic shunt alloy temperature, and thus a magnetic path is easily formed. Therefore, a magnetic path can be formed without a problem even if the IH coil unit 52 separates from the fixing belt 50 at a low magnetic shunt alloy temperature.

Hereinafter, a state in which a magnetic shunt alloy temperature is high will be described with reference to FIG. 7.

As illustrated in FIG. 7, the eccentric cam 91 moves the IH coil unit 52 in an arrow F2 direction while resisting against the elastic force of the elastic member 93. The eccentric cam 91 is stopped at a position where the long side s1 thereof comes into contact with the rear surface of the IH coil unit 52. The eccentric cam 91 is stopped at a position where the short side s2 thereof separates from the support member 94. The IH coil unit 52 resists against the elastic force of the elastic member 93 and thus approaches the outer circumferential surface of the fixing belt 50. The front surface of the IH coil unit 52 separates from the outer circumferential surface of the fixing belt 50 with the second gap Lg2 smaller than the first gap Lg1.

The position of the IH coil unit 52 at a high magnetic shunt alloy temperature is closer to the fixing belt 50 than the position of the IH coil unit 52 at a high magnetic shunt alloy temperature. As the IH coil unit 52 becomes closer to the fixing belt 50, magnetic flux is strengthened. Magnetic flux when the IH coil unit 52 separates from the fixing belt 50 with the second gap Lg2 therebetween is stronger than magnetic flux when the IH coil unit 52 separates from the fixing belt 50 with the first gap Lg1 (refer to FIG. 6) therebetween. Here, electric resistance of the magnetic shunt alloy at a high magnetic shunt alloy temperature is smaller than at a low magnetic shunt alloy temperature, and thus a magnetic path is hard to form. Thus, at a high magnetic shunt alloy temperature, in order to supplement the reduction in the electric resistance of the magnetic shunt alloy, the IH coil unit 52 approaches the fixing belt 50.

A switch time from a high magnetic shunt alloy temperature to a low magnetic shunt alloy temperature may be adjusted by adjusting a rotation speed of the cam motor 92.

Hereinafter, a detailed description will be made of a control system 110 of the IH coil unit 52 which causes the fixing belt 50 to generate heat.

Figure 5:
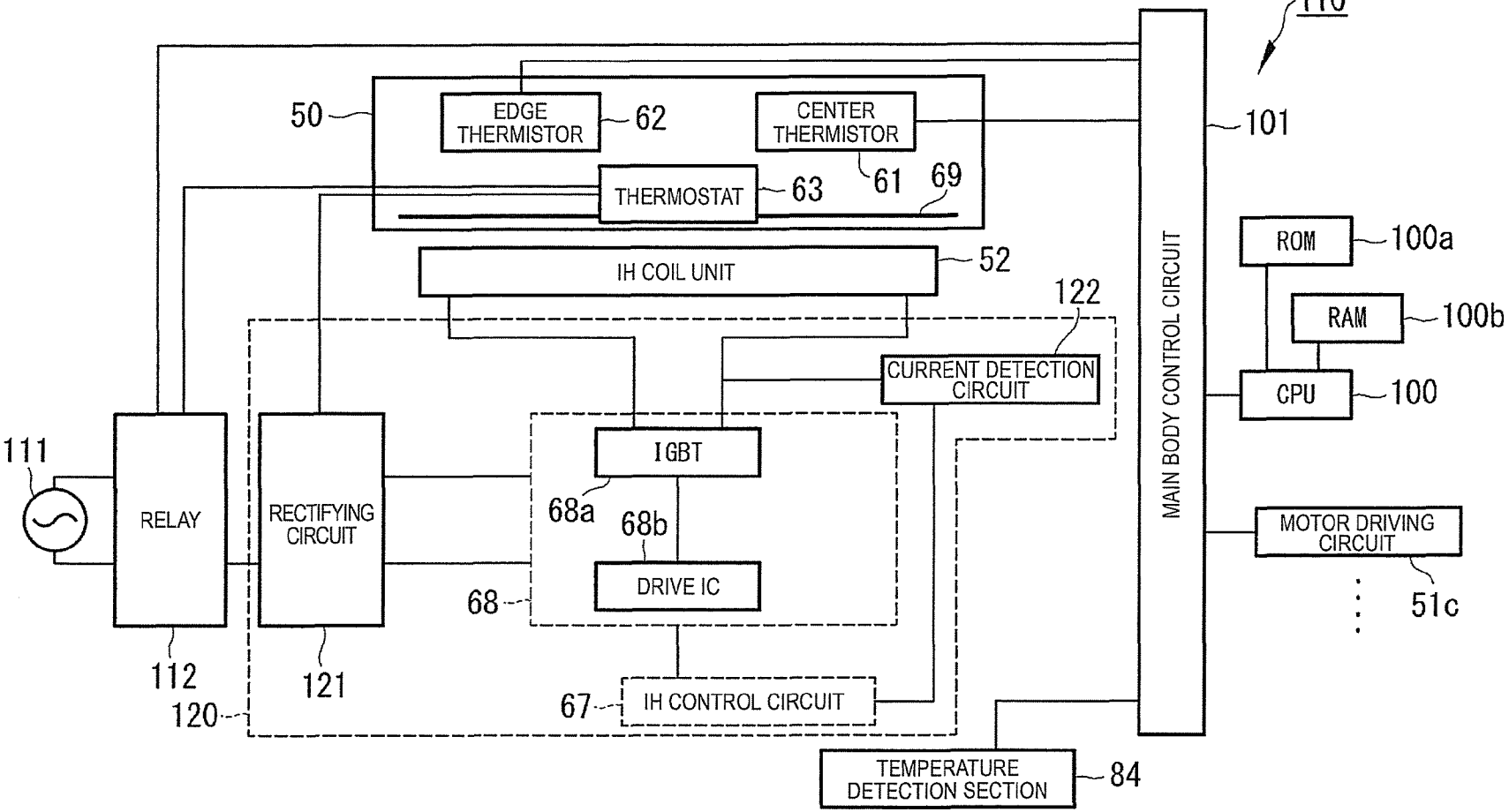
FIG. 5 is a block diagram illustrating a control system which mainly controls the IH coil unit.

FIG. 5 is a block diagram illustrating the control system 110 which mainly controls the IH coil unit 52 according to the exemplary embodiment.

As illustrated in FIG. 5, the control system 110 includes the CPU 100, a read only memory (ROM) 100*a*, a random access memory (RAM) 100*b*, the main body control circuit 101, an IH circuit 120, and the motor driving circuit 51*c*.

In the control system 110, the IH circuit 120 supplies power to the IH coil unit 52. The IH circuit 120 includes a rectifying circuit 121, the IH control circuit 67, the inverter driving circuit 68, and a current detection circuit 122.

A current is input to the IH circuit 120 from an AC power source 111 via a relay 112. The IH circuit 120 rectifies the input current with the rectifying circuit 121 so as to supply the rectified current to the inverter driving circuit 68. The relay 112 cuts off a current from the AC power source 111 if the thermostat 63 is stopped. The inverter driving circuit 68 includes the IGBT element 68*a*, and a drive IC 68*b*. The IH control circuit 67 controls the drive IC 68*b* on the basis of detection results from the center thermistor 61 and the edge thermistor 62. The IH control circuit 67 controls the drive IC 68*b* so as to control an output from the IGBT element 68*a*. The current detection circuit 122 sends a detection result of the output from the IGBT element 68*a* to the IH control circuit 67. The IH control circuit 67 controls the drive IC 68*b* so that constant power is supplied to the coil 56 on the basis of the detection result from the current detection circuit 122.

The main body control circuit 101 receives the temperature of the auxiliary heat generation plate 69 from the temperature detection section 84. The main body control circuit 101 controls the IH coil unit 52 on the basis of the temperature of the auxiliary heat generation plate 69. The main body control circuit 101 controls whether the fixing device 34 is continuously driven or an output from the IH coil unit 52 is reduced on the basis of a detection result from the auxiliary heat generation plate 69. The reduction in the output from the IH coil unit 52 includes stoppage of the IH coil unit 52.

Hereinafter, a description will be made of an operation of the fixing device 34 during warming-up.

As illustrated in FIG. 2, during warming-up, the fixing device 34 rotates the press roller 51 in the arrow q direction so that the fixing belt 50 is driven-rotated in the arrow u direction. The IH coil unit 52 generates magnetic flux on the fixing belt 50 side when the inverter driving circuit 68 applies a high frequency current thereto.

As illustrated in FIG. 4, the magnetic flux from the IH coil unit 52 induces the first magnetic path 81 which passes through the heat generation layer 50*a* of the fixing belt 50 so that the heat generation layer 50*a* generates heat. The magnetic flux from the IH coil unit 52, penetrating through the fixing belt 50 induces the second magnetic path 82 which passes through the auxiliary heat generation plate 69 so that the auxiliary heat generation plate 69 generates heat. The second magnetic path 82 formed between the heat generation layer 50*a* and the auxiliary heat generation plate 69 assists heating of the heat generation layer 50*a*.

As illustrated in FIG. 2, the IH control circuit 67 controls the inverter driving circuit 68 on the basis of a detection result from the center thermistor 61 or the edge thermistor 62. The inverter driving circuit 68 supplies a high frequency current to the coil 56.

Hereinafter, a description will be made of an operation of the fixing device 34 during a fixing operation.

If there is a printing request after the fixing belt 50 reaches a fixing temperature and finishes warming-up, the MFP 10 (refer to FIG. 1) starts a printing operation. The MET 10 forms a toner image on the sheet P in the printer unit 18 and transports the sheet P to the fixing device 34.

In the MFP 10, the sheet P on which the toner image is formed passes the nip 54 between the fixing belt 50 reaching the fixing temperature and the press roller 51. The fixing device 34 fixes the toner image to the sheet P. During the fixing, the IH control circuit 67 controls the IH coil unit 52 so that the fixing belt 50 is kept at the fixing temperature.

Due to the fixing operation, the heat of the fixing belt 50 is taken by the sheet P. For example, if sheets continuously pass at a high speed, heat is excessively taken by the sheet P, and thus the fixing belt 50 with low heat capacity may not be kept at the fixing temperature. The heating of the fixing belt 50 is assisted by the second magnetic path 82 formed between the heat generation layer 50*a* and the auxiliary heat generation plate 69, and thus deficiency of a belt heat generation amount is supplemented. Since the fixing belt 50 is heated by the second magnetic path 82, a temperature of the fixing belt 50 is maintained to be the fixing temperature even if sheets continuously pass at a high speed.

Meanwhile, the auxiliary heat generation plate 69 may excessively increase a temperature of the IGBT element 68*a* and thus the IGBT element 68*a* may be damaged when a high output is continued, such as during continuous sheet passing or during warming-up. Particularly, if the auxiliary heat generation plate 69 is made of a magnetic shunt alloy, the IGBT element 68*a* may be seriously damaged. If the auxiliary heat generation plate 69 is made of the magnetic shunt alloy, the auxiliary heat generation plate 69 has characteristics in which load resistance of the auxiliary heat generation plate 69 notably decreases when the Curie point is exceeded. Therefore, if the auxiliary heat generation plate 69 is made of the magnetic shunt alloy, load resistance of the auxiliary heat generation plate 69 notably decreases when the Curie point is exceeded, and therefor an excessive amount of current flows through the IGBT element 68*a*.

For example, in order to prevent damage of the IGBT element 68*a*, a thermistor which detects a temperature of the IGBT element 68*a* may be provided. If the thermistor detects an increase in the temperature of the IGBT element 68*a*, the main body control circuit 101 drives a fan so as to cool the IGBT element 68*a*. The thermistor can detect a smooth temperature increase of the IGBT element 68*a*. However, the thermistor is unlikely to detect a rapid temperature increase and has a limitation in tracking a temperature of the IGBT element 68*a*. A temperature of the IGBT element 68*a* detected by the thermistor may be different from an actual internal temperature of the IGBT element 68*a*. In addition, when the IGBT element 68*a* is cooled by using the fan, cooling up to the inside of the IGBT element 68*a* is unlikely to be performed, and there is a limitation in sufficiently cooling the IGBT element 68*a*. Therefore, the IGBT element 68*a* may not be prevented from being damaged in detection of a temperature using the thermistor and in cooling using the fan.

In contrast, according to the exemplary embodiment, there is provided the temperature detection section 84 which detects a temperature of the auxiliary heat generation plate 69. Since the temperature detection section 84 detects a temperature of the auxiliary heat generation plate 69, a magnetism change (load resistance) of the auxiliary heat generation plate 69 can be indirectly detected. Since the temperature detection section 84 detects a temperature of the auxiliary heat generation plate 69, a smooth temperature increase and a rapid temperature increase of the IGBT element 68*a* can be indirectly detected. Since the temperature detection section 84 detects a temperature of the auxiliary heat generation plate 69, a temperature of the IGBT element 68*a* can be indirectly detected in real time when compared with a case where the thermistor is provided. Since the temperature detection section 84 indirectly detects load resistance of the auxiliary heat generation plate 69, the above-described difference from an actual internal temperature of the IGBT element 68*a* is not problematic. The main body control circuit 101 reduces an output from the IH coil unit 52 on the basis of a detection result from the temperature detection section 84. If the main body control circuit 101 determines that a temperature of the auxiliary heat generation plate 69 is equal to or higher than the threshold temperature T1, an output from the IH coil unit 52 can be reduced. For example, by stopping the IH coil unit 52 or reducing an output from the IH coil unit 52, a temperature of the IGBT element 68*a* can be prevented from excessively increasing. Therefore, the IGBT element 68*a* can be prevented from being damaged.

Meanwhile, the magnetic shunt alloy has characteristics in which load resistance considerably decreases when the Curie point is exceeded. Therefore, if the fixing belt 50 is to be heated with constant power at a high magnetic shunt alloy temperature at which the load resistance decreases, a heat generation load of the IGBT element 68*a* may increase.

In contrast, according to the exemplary embodiment, at a high magnetic shunt alloy temperature, the motor driving circuit 51*c* causes the IH coil unit 52 to approach the outer circumferential surface of the fixing belt 50. Since the IH coil unit 52 approaches the outer circumferential surface of the fixing belt 50, magnetic flux is stronger at a high magnetic shunt alloy temperature than at a low magnetic shunt alloy temperature. Since electric resistance of the magnetic shunt alloy is smaller at a high magnetic shunt alloy temperature than at a low magnetic shunt alloy temperature, a magnetic path is hard to form. At a high magnetic shunt alloy temperature, in order to supplement the reduction in the electric resistance of the magnetic shunt alloy, the IH coil unit 52 approaches the outer circumferential surface of the fixing belt 50. By supplementing the reduction in the electric resistance of the magnetic shunt alloy at a high magnetic shunt alloy temperature, heating of the fixing belt 50 is promoted. By promoting heating of the fixing belt 50 at a high magnetic shunt alloy temperature, the heat generation load of the IGBT element 68*a* can be prevented from increasing.

The driving section 90 includes the eccentric cam 91 which is rotated centering on the shaft 91*a* parallel to the belt width direction. The eccentric cam 91 is in contact with the IH coil unit 52 or is in contact with the support member 94. Since the driving section 90 includes the eccentric cam 91, a configuration of the driving section 90 can be simplified.

The shield 76 supporting the auxiliary heat generation plate 69 is made of a nonmagnetic material. The shield 76 shields the magnetic flux from the IH coil unit 52. Since the shield 76 shields the magnetic flux from the IH coil unit 52, the shield 76 can prevent the magnetic flux from the IH coil unit 52 from influencing the internal members of the fixing belt 50.

If the auxiliary heat generation plate 69 is in contact with the inner circumferential surface of the fixing belt 50, the motor driving circuit 51*c* may control the cam motor 92 on the basis of detection results from the center thermistor 61 and the edge thermistor 62. Since the center thermistor 61 and the edge thermistor 62 detect a temperature of the fixing belt 50, the temperature of the auxiliary heat generation plate 69 can be indirectly detected.

According to at least one exemplary embodiment described above, there is provided the temperature detection section 84 which detects the temperature of the auxiliary heat generation plate 69. The main body control circuit 101 reduces an output from the IH coil unit 52 on the basis of a detection result from the temperature detection section 84. If the main body control circuit 101 determines that the temperature of the auxiliary heat generation plate 69 is equal to or higher than the threshold temperature T1, an output from the IH coil unit 52 can be reduced. For example, by stopping the IH coil unit 52 or reducing an output from the IH coil unit 52, the temperature of the IGBT element 68*a* can be prevented from excessively increasing. Therefore, the IGBT element 68*a* can be prevented from being damaged.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. A fixing device comprising:

a fixing belt that includes a conductive layer;

an induced current generation section that opposes the fixing belt in a thickness direction, performs electromagnetic induction heating on the conductive layer, and is disposed further toward an outside of the fixing belt in a diameter direction than an outer circumferential surface of the fixing belt;

an auxiliary heat generation section that opposes the induced current generation section with the fixing belt interposed therebetween, and is disposed further toward an inside of the fixing belt in the diameter direction than an inner circumferential surface of the fixing belt;

a temperature detection section that detects a temperature of the auxiliary heat generation section; and a control section that relatively moves the outer circumferential surface of the fixing belt and the induced current generation section on the basis of a detection result from the temperature detection section.

2. The device according to claim 1, further comprising:

a driving section that relatively moves the induced current generation section and the fixing belt.

3. The device according to claim 1, wherein, if a temperature of the auxiliary heat generation section is equal to or higher than a threshold temperature, the control section causes the induced current generation section to approach the outer circumferential surface of the fixing belt.

4. The device according to claim 1, wherein, if a temperature of the auxiliary heat generation section is lower than a threshold temperature, the control section causes the induced current generation section to separate from the outer circumferential surface of the fixing belt.

5. The device according to claim 2, wherein the driving section includes an eccentric cam that is rotated centering on a shaft parallel to a width direction of the fixing belt, and wherein the eccentric cam is in contact with the induced current generation section or is in contact with a support member supporting the induced current generation section.

6. The device according to claim 1, further comprising:

a belt temperature detection section that detects a temperature of the fixing belt, wherein, if the auxiliary heat generation section is in contact with the inner circumferential surface of the fixing belt, the control section relatively moves the outer circumferential surface of the fixing belt and the induced current generation section on the basis of a detection result from the belt temperature detection section.

7. The device according to claim 1, further comprising:

a shield that supports the auxiliary heat generation section, wherein the shield is made of a nonmagnetic material.

8. An image forming apparatus comprising:

an image forming section that forms an image on a recording medium; and the fixing device according to claim 1 that fixes the image to the recording medium.

9. The device according to claim 1, wherein the control section reduces an output from the induced current generation section on the basis of the detection result from the temperature detection section.

* * * * *